US007001248B1

(12) United States Patent
Chen et al.

(10) Patent No.: US 7,001,248 B1
(45) Date of Patent: Feb. 21, 2006

(54) FINE TILTING ADJUSTMENT MECHANISM FOR GRINDING MACHINE

(75) Inventors: Shih-Chang Chen, Hsinchu (TW); Lei-Yi Chen, Hsinchu (TW); Chieh-Lung Lai, Taichung (TW)

(73) Assignee: Industrial Technology Research, Institute, Hsinchu (TW)

( * ) Notice: Subject to any disclaimer, the term of this patent is extended or adjusted under 35 U.S.C. 154(b) by 0 days.

(21) Appl. No.: 11/027,370

(22) Filed: Dec. 29, 2004

(51) Int. Cl.
*B24B 1/00* (2006.01)

(52) U.S. Cl. ..... 451/14; 451/10; 451/178

(58) Field of Classification Search ..... 451/10, 451/11, 14, 178, 231, 242, 246, 259, 278, 451/285
See application file for complete search history.

(56) References Cited

U.S. PATENT DOCUMENTS 4,051,634 A * 10/1977 Fisher ..... 451/242
4,481,742 A * 11/1984 Shimizu et al. ..... 451/14
4,829,716 A * 5/1989 Ueda et al. ..... 451/292
5,503,589 A * 4/1996 Wikle ..... 451/5
5,558,557 A * 9/1996 Dashevsky ..... 451/10
5,649,853 A * 7/1997 Kuo ..... 451/178
6,910,946 B1 * 6/2005 Yoon ..... 451/8

* cited by examiner

*Primary Examiner*—Eileen P. Morgan
(74) *Attorney, Agent, or Firm*—W. Wayne Liauh

(57) ABSTRACT

Provided is a grinding machine comprising a carrier adapted to raise or lower, the carrier including a V-shaped groove across its top and a forward pad at either side, a spindle unit including an inverted L-shaped mounting plate, and a fine tilting adjustment mechanism comprising first, second, third, and fourth screw type fastening units for fastening horizontal and vertical portion of the mounting plate at the carrier. Each screw of the fastening units is spaced from the carrier by a peripheral gap. The gaps are adapted to allow the horizontal or vertical portion of the mounting plate and thus the spindle unit to either tilt to the left or right or tilt to the front or rear with respect to the carrier in response to unfastening the screws and loosening adjustment screws of the fastening units.

10 Claims, 12 Drawing Sheets

FINE TILTING ADJUSTMENT MECHANISM FOR GRINDING MACHINE

BACKGROUND OF THE INVENTION

1. Field of Invention

The present invention relates to grinding machines and more particularly to a screw based mechanism for fine tilting adjustment of a spindle unit prior to operating the spindle unit to grind a semiconductor wafer to a predetermined thickness.

2. Related Art

The minimum encapsulation size of a semiconductor wafer produced in a manufacturing process is decided by thinning. Surface roughness, thickness variance, and performance are important factors in the thinning process. In a first half of the thinning process, devices formed on the wafer are separated by dicing (i.e., sawing). For eliminating traces left by sawing, grinding is performed on the wafer for making the wafer having a surface flatness sufficient for a subsequent polishing process. For an 8" wafer, its total thickness variance (TTV) is required to be equal to or less than 5 $\mu$m.

For example, a grinding machine shown in FIG. 1 is disclosed in U.S. Pat. No. 6,685,542 in which two rotary screw rods (one is shown) 51 are laid on an upright wall 50, two spindle units 52 (one is shown) each is adapted to raise or lower by rotating the rotary screw rod 51, a grinding wheel 53 is attached to a lower surface of either spindle unit 52, the grinding wheel 53 having segments of fine or coarse grindstone 54, three chuck tables (one is shown) 55 are rotatably fixed to a turntable, and two adjustment screws 56 are provided below each chuck table (e.g., chuck table 55). The adjustment screws 56 are adapted to turn to adjust the tilting angle of the chuck table 55 for being adapted to the angle of an approaching cutter in the grinding.

However, the first prior art suffered from several disadvantages. For example, it is relatively complex in constructions due to the provisions of two adjustment screws 56 below each chuck table 55 and other associated taking and putting equipment and transporting means. Moreover, the chuck tables 55 are adjustable, resulting in a decrease of its supporting capability (i.e., less stiff). In brief, the tilting adjustment mechanism is not desirable.

In another example a grinding machine shown in FIG. 2 is disclosed in Japanese Patent Laid-Open No. 11-309,673 in which a carrier 61 is slidably mounted on an upright wall 60, a pivot axis 62 is interconnected the carrier 61 and a forward block member 63, a wedge member 65 is provided at an upper part of the block member 63, a rotary screw rod 64 has a lower end threadedly engaged with the wedge member 65, a spindle unit 66 is threadedly engaged with a front portion of the wedge member 65 by means of upper and lower screws 67, an upper ball 69 is provided in an upper V-shaped groove 68 of the spindle unit 66 to be in rotatable contact with an inclined surface of the wedge member 65, and a lower ball is provided in a lower V-shaped groove of the spindle unit 66 to be in rotatable contact with the block member 63. For tilting the spindle unit 66, first unfasten the screws 67, and then rotate the rotary screw rod 64 to raise or lower the wedge member 65. As a result, either the spindle unit 66 tilts clockwise if the wedge member 65 raises or the spindle unit 66 tilts counterclockwise if the wedge member 65 lowers. This is the tilting adjustment operation of the spindle unit 66.

Referring to FIG. 3, a U-shaped mount 70 is provided on a top of the carrier 61 and above the block member 63 by a small distance. A pressing member 72 is provided in the recess of the U-shaped mount 70. A rotary screw rod 71 is threadedly engaged between the pressing member 72 and one lateral portion of the mount 70 such that the pressing member 72 may move by rotating the rotary screw rod 71. The center of gravity of the block member 63 changes in response to the movement of the pressing member 72. And in turn, the block member 63 pivots about the pivot axis 62. This is the tilting adjustment operation of the block member 63.

However, the second prior art suffered from several disadvantages. For example, weights of both the block member 63 and the spindle unit 66 concentrate on the pivot axis 62, resulting in a breaking of the pivot axis 62 (i.e., useful life shortened). Further, the block member 63 is not able to maintain the angle of being tilted due to no positioning device associated therewith. This is not desired in the grinding operation. Thus, the need for improvement still exists.

SUMMARY OF THE INVENTION

It is therefore an object of the present invention to, in a grinding machine comprising an upright wall extended upwardly from its base, and an assembly provided at one side of the wall, the assembly including a rotary screw rod, a carrier threadedly engaged with the rotary screw rod for raising or lowering therealong, the carrier including a V-shaped groove across its top and a forward pad at either side, and a spindle unit including an inverted L-shaped mounting plate having a horizontal portion and a vertical portion, a grinding wheel attached to its lower surface, and segments of grindstone fixed to a lower surface of the grinding wheel, provide a fine tilting adjustment mechanism mountable on the grinding machine comprising first and second fastening units provided at both sides of the horizontal portion of the mounting plate respectively, each of the first and second fastening units including two first screws driven home through the groove to secure the horizontal portion of the mounting plate to the carrier, and an intermediate adjustment screw adjustably driven through the horizontal portion of the mounting plate to contact the groove with its half spherical end; and third and fourth fastening units provided at lower portions of both sides of the vertical portion of the mounting plate respectively, each of the third and fourth fastening units including two first screws driven home through the pad to secure the vertical portion of the mounting plate to the carrier, and an intermediate adjustment screw adjustably driven through the vertical portion of the mounting plate to contact either pad with its half spherical end.

In one aspect of the present invention, either first screw of each of the first and second fastening units is spaced from the carrier by a peripheral gap having a depth about equal to a distance from the groove to a head of the first screw, the gaps adapted to allow the horizontal portion of the mounting plate and the spindle unit to tilt either to the left or to the right with respect to the carrier in response to unfastening the first screws of the first and second fastening units, loosening the adjustment screw of the first fastening unit by turning a first number of times, and loosening the adjustment screw of the second fastening unit by turning a second number of times different from the first number of times.

In another aspect of the present invention, either first screw of each of the third and fourth fastening units is spaced from the carrier by a peripheral gap having a depth about equal to a distance from either pad to a head of the first screw, the gaps adapted to allow the vertical portion of the mounting plate and the spindle unit to tilt either to the front or to the rear with respect to the adjustment screws of the first and second fastening units in response to unfastening the first screws of the third and fourth fastening units and loosening the adjustment screws of the third and fourth fastening units by turning the same number of times.

In yet another aspect of the present invention, the carrier further comprises a lower bracket having a curved upper portion urged against a bottom of the vertical portion of the mounting plate.

The above and other objects, features and advantages of the present invention will become apparent from the following detailed description taken with the accompanying drawings.

DETAILED DESCRIPTION OF THE INVENTION

Figure 1:
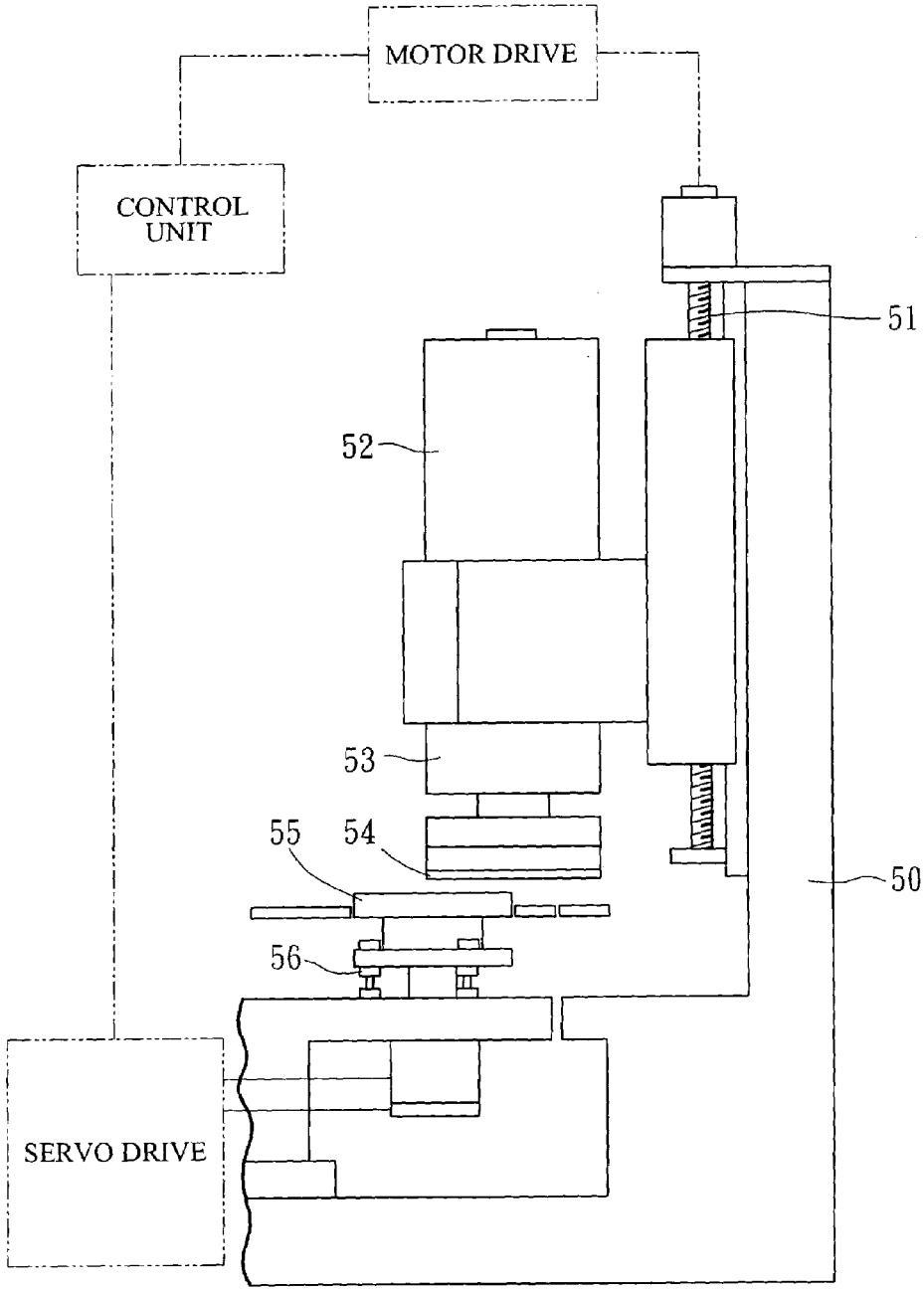
F I G . 1 PRIOR ART
FIG. 1 is a side schematic view of a grinding machine disclosed in U.S. Pat. No. 6,685,542.
Figure 2:
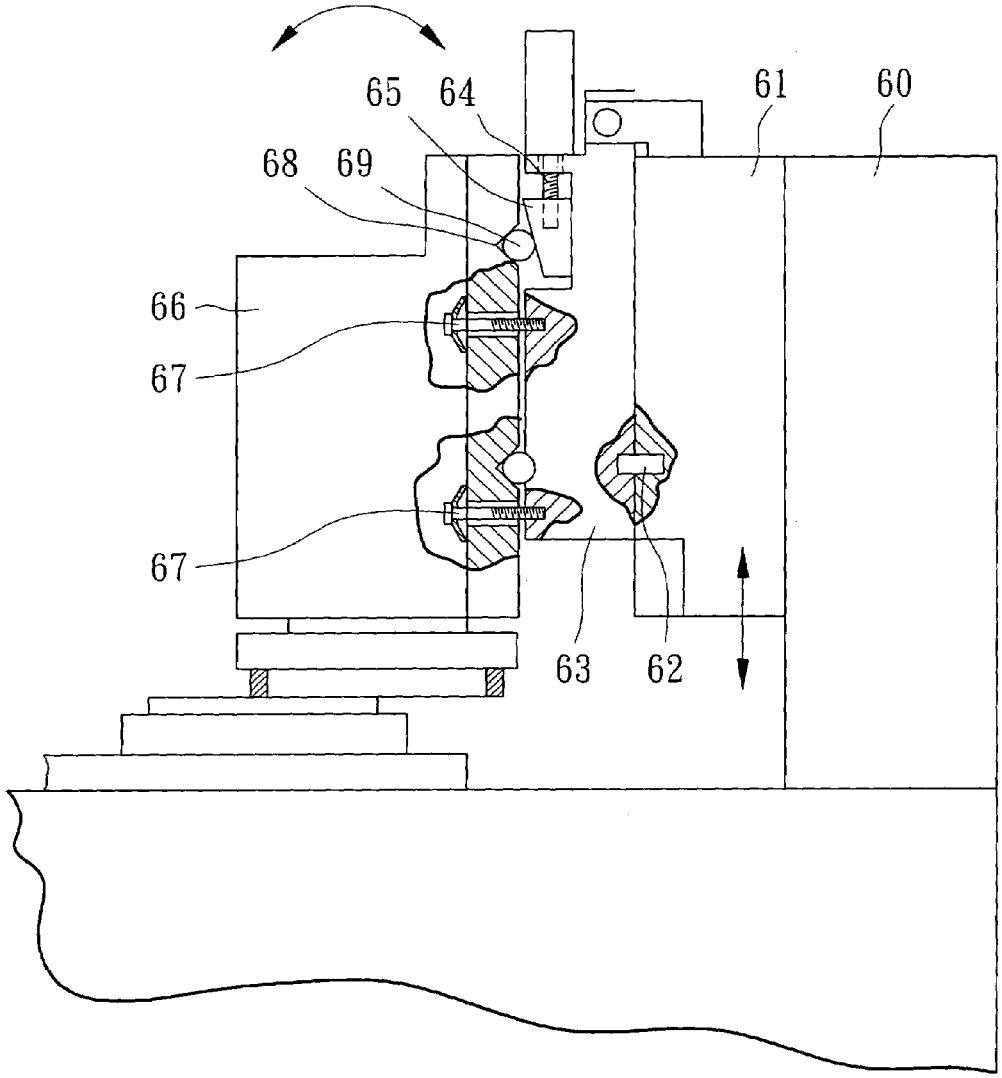
F I G . 2 PRIOR ART
FIG. 2 is a side schematic view in part section of another grinding machine disclosed in Japanese Patent Laid-Open No. 11-309,673.
Figure 3:
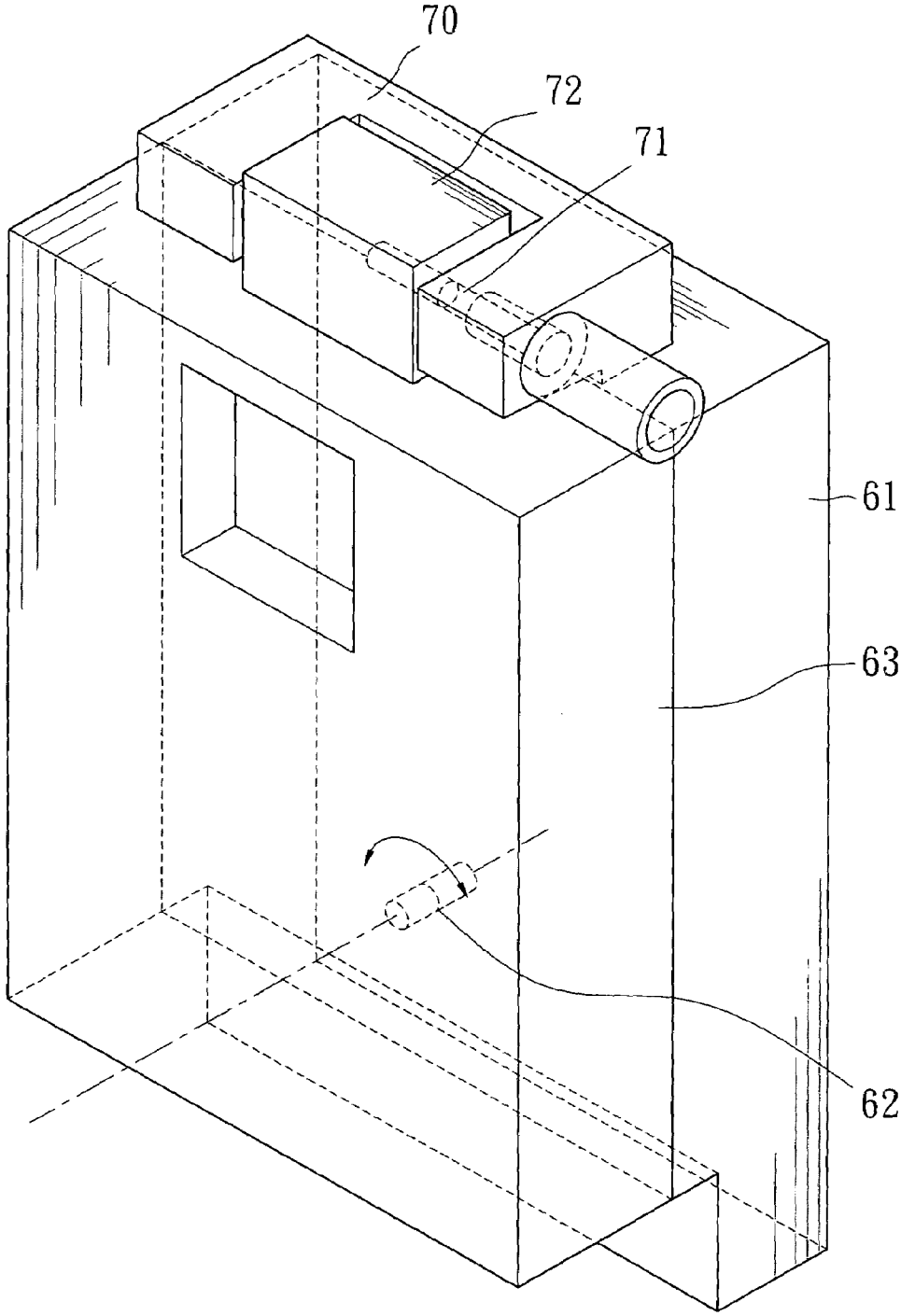
F I G . 3 PRIOR ART
FIG. 3 is a perspective view of the carrier and the block member of FIG. 2 for showing a tilting adjustment operation of a block member about a carrier by moving a pressing member.
Figure 4:
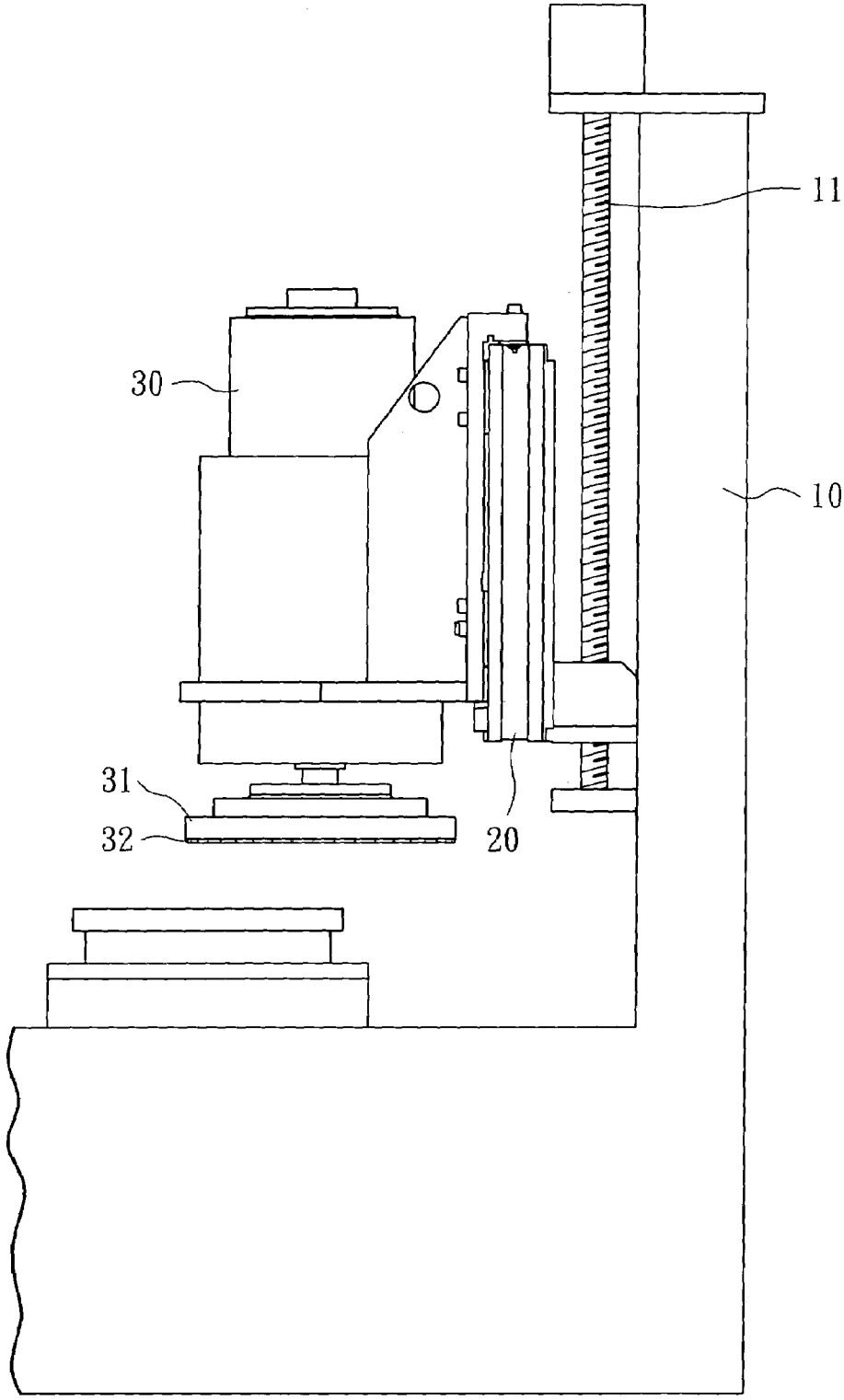
FIG. 4 is a side view of a grinding machine incorporating a preferred embodiment of fine tilting adjustment mechanism according to the invention.

Referring to FIG. 4, there is shown a grinding machine in accordance with a preferred embodiment of the invention. The grinding machine comprises an upright wall 10 extended upwardly from its base and a carrier assembly provided at one side of the wall 10. The carrier assembly comprises a longitudinal rotary screw rod 11, a carrier 20 threadedly engaged with the rotary screw rod 11 for riding thereon (i.e., raising or lowering), and a spindle unit 30 attached to the carrier 20, the spindle unit 30 including a grinding wheel 31 attached to its lower surface, and segments of grindstone 32 fixed to a lower surface of the grinding wheel 31.

Figure 5:
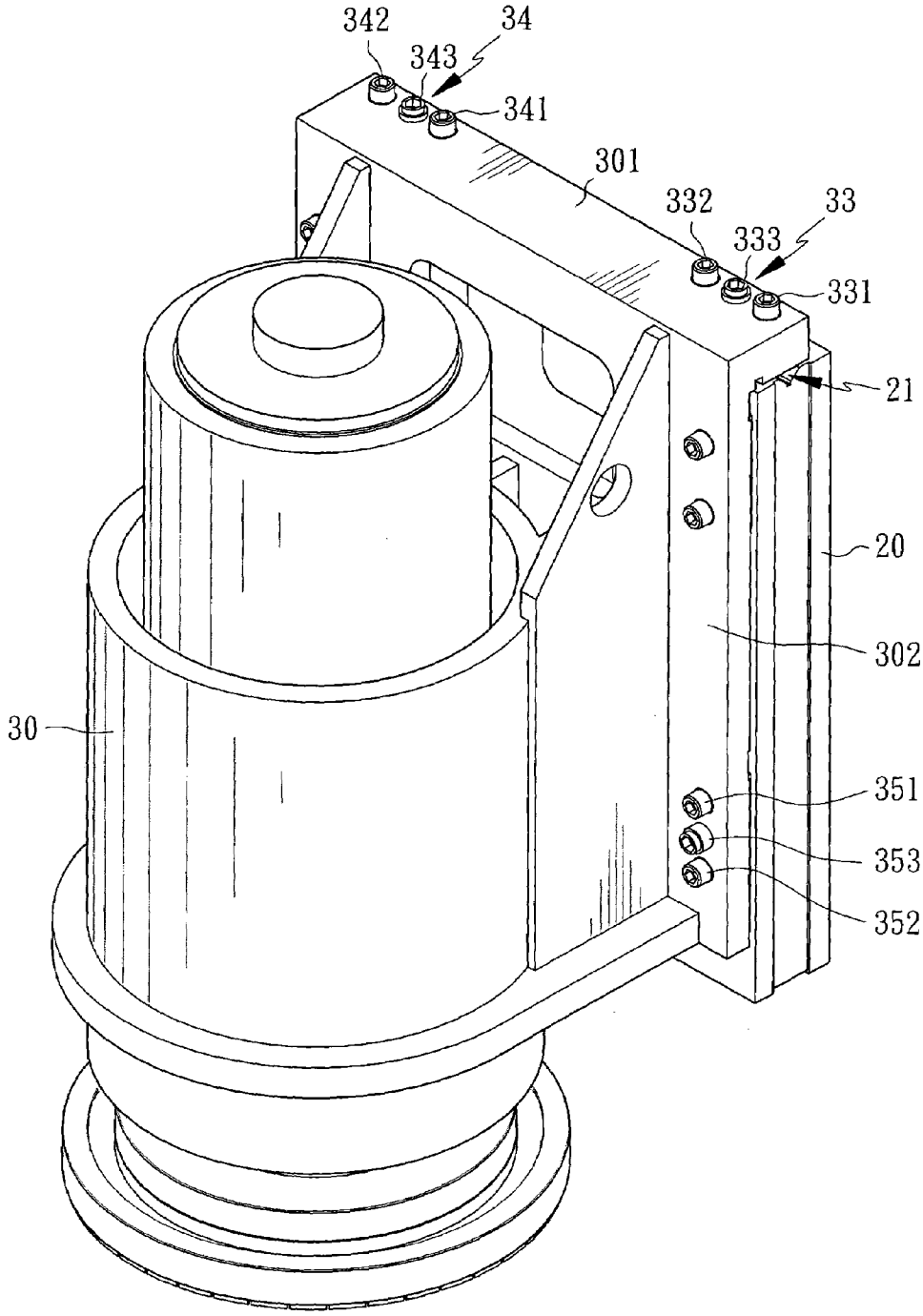
FIG. 5 is a perspective view of the fine tilting adjustment mechanism of FIG. 4.
Figure 6:
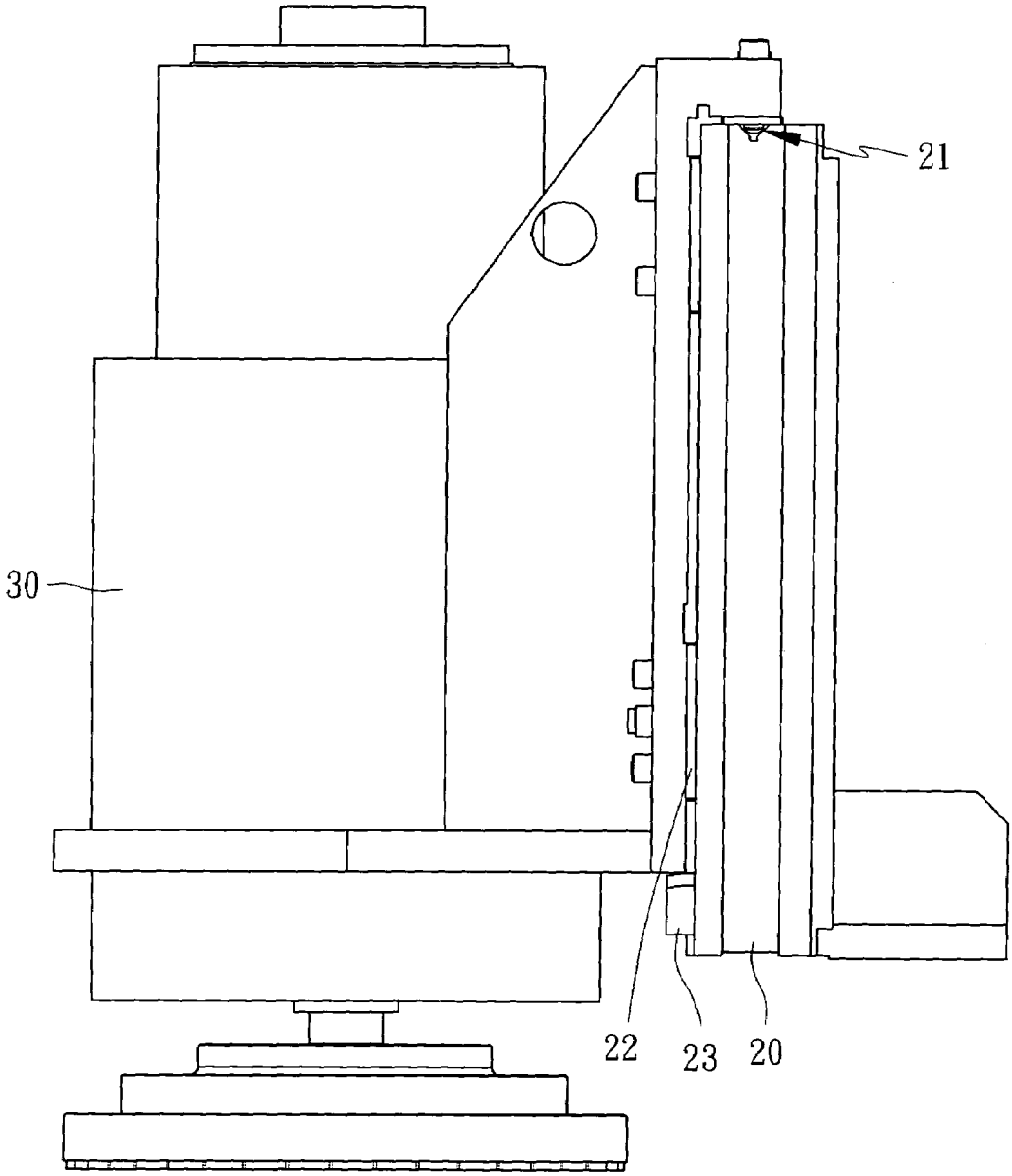
FIG. 6 is a side view of the fine tilting adjustment mechanism of FIG. 5.
Figure 7:
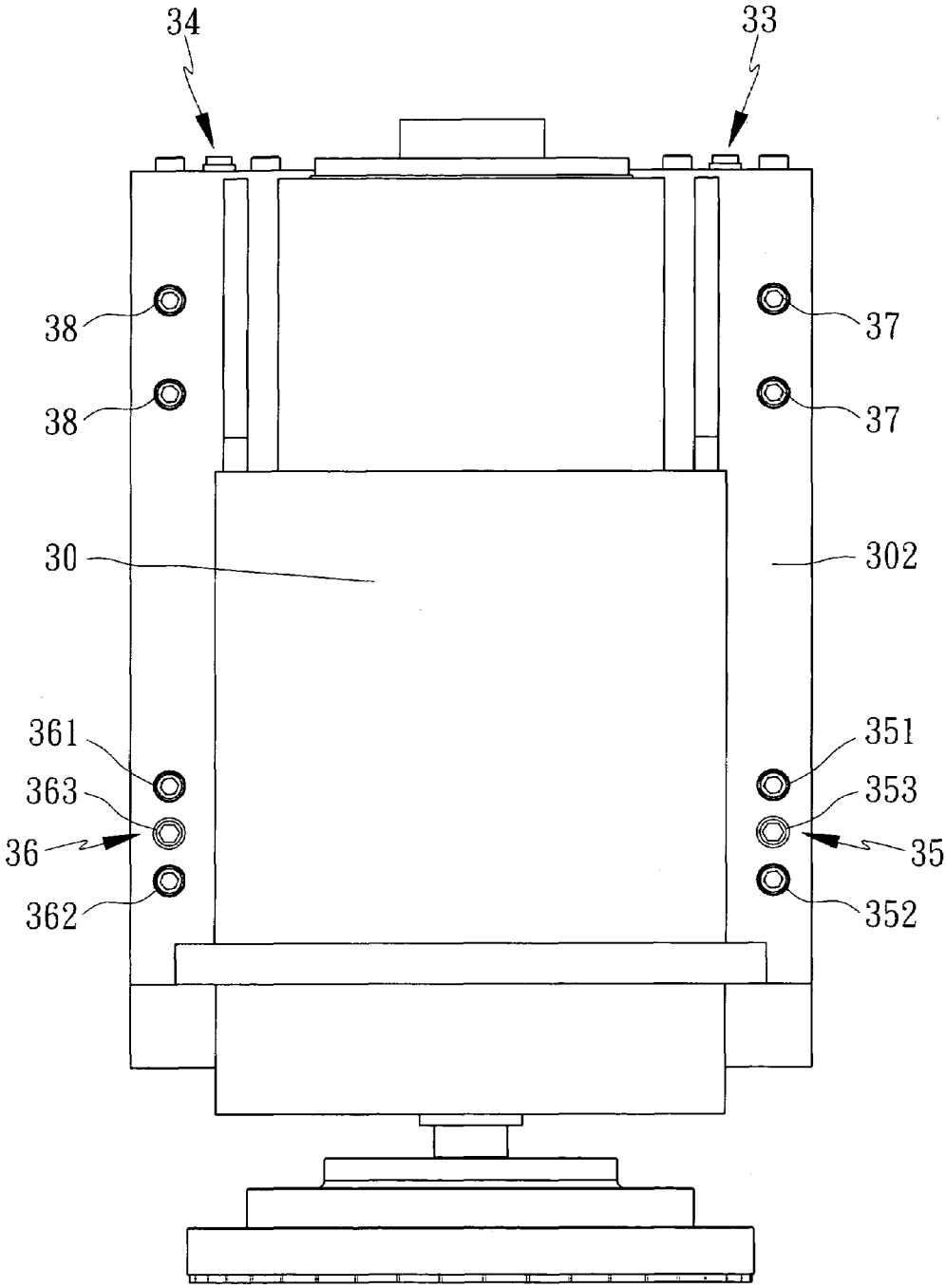
FIG. 7 is a front view of the fine tilting adjustment mechanism of FIG. 5.

Referring to FIGS. 5, 6, and 7, a fine tilting adjustment mechanism for increasing efficiency and grinding semiconductor wafers is provided on the spindle unit 30 according to the invention. The fine tilting adjustment mechanism comprises a V-shaped groove 21 across a top of the carrier 20, the groove 21 being treated by surface hardening, and a forward pad 22 at either side, also the pads 22 being treated by surface hardening. The mechanism further comprises the spindle unit 30 comprising, in addition to the components described in the last paragraph, an inverted L-shaped mounting plate having a horizontal portion 301 and a vertical portion 302 laid on the carrier 20, the horizontal portion 301 secured onto the groove 21 by means of a first fastening unit 33 and a second fastening unit 34 proximate both sides in which the first fastening unit 33 comprises two screws 331 and 332 driven home through the groove 21 to secure the horizontal portion 301 to carrier 20, and an intermediate adjustment screw 333 adjustably driven through the horizontal portion 301 to contact the groove 21 with its half spherical end, the second fastening unit 34 comprises two screws 341 and 342 driven home through the groove 21 to secure the horizontal portion 301 to carrier 20, and an intermediate adjustment screw 343 adjustably driven through the horizontal portion 301 to contact the groove 21 with its half spherical end, the vertical portion 302 secured to the carrier 20 by means of a third fastening unit 35 and a fourth fastening unit 36 proximate lower portions of both sides in which the third fastening unit 35 comprises two screws 351 and 352 driven home through one pad 22 to secure the vertical portion 302 to the carrier 20, and an intermediate adjustment screw 353 adjustably driven through the vertical portion 302 to contact one pad 21 with its half spherical end, the second fastening unit 34 comprises two screws 361 and 362 driven home through the other pad 22 to secure the vertical portion 302 to the carrier 20, and an intermediate adjustment screw 363 adjustably driven through the vertical portion 302 to contact the other pad 21. The mechanism further comprises two pairs of screws 37 and 38 driven home to threadedly secure upper portions of both sides of the vertical portion 302 to the carrier 20. As such, the mounting of the spindle unit 30 onto the carrier 20 is more secure. The carrier 20 further comprises a lower bracket 23 having a curved upper portion urged against a bottom of the vertical portion 302. The bracket 23 not only can support the spindle unit 30 but also can allow the spindle unit 30 to smoothly ride on its curved upper portion when the spindle unit 30 is slightly moving forwardly, rearward, leftward, or rightward in a fine tilting adjustment operation as detailed later.

Figure 8:
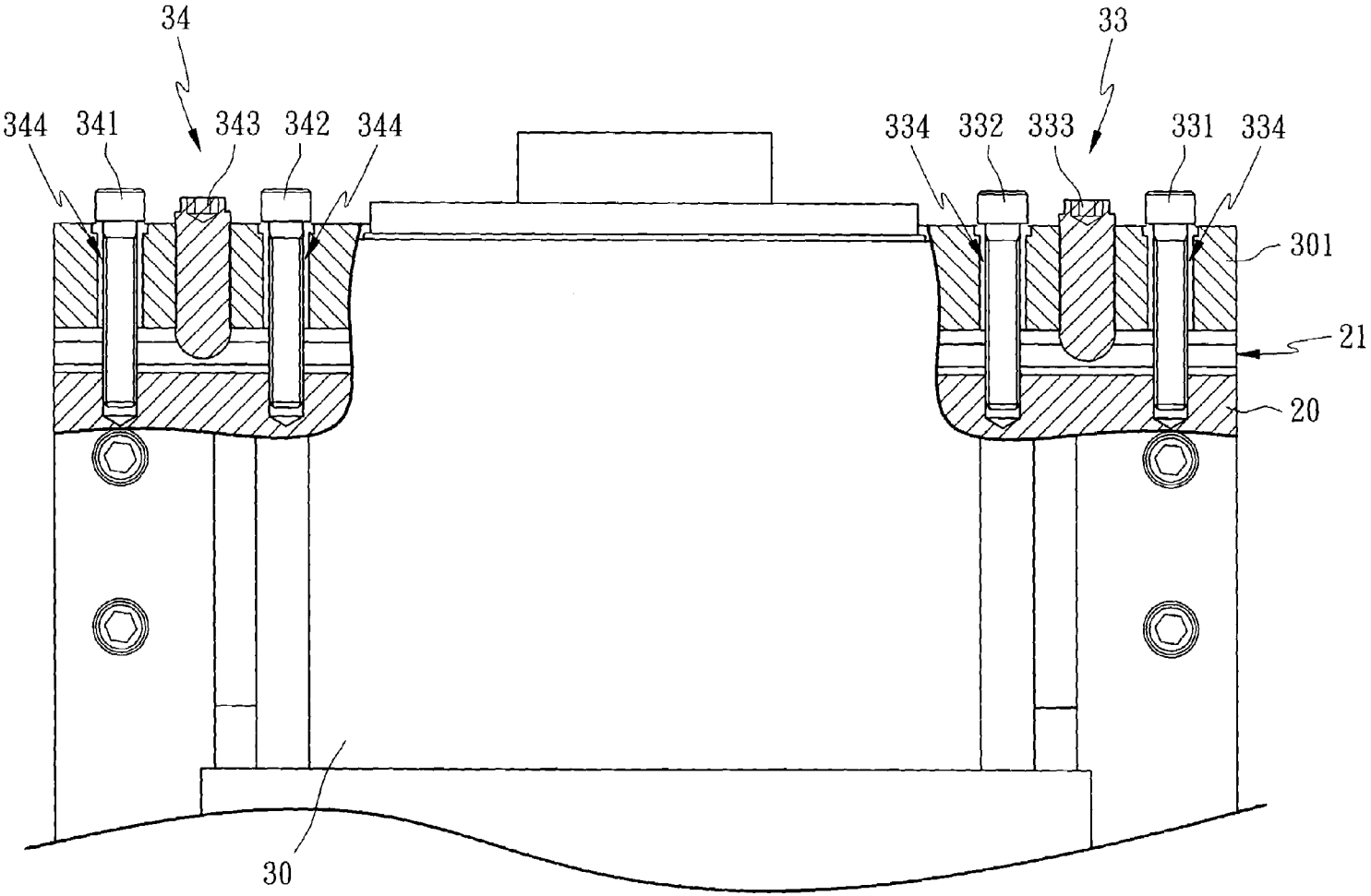
FIG. 8 is an enlarged view of an upper portion of FIG. 7 in part section for showing a left or right tilting adjustment operation of the fine tilting adjustment mechanism.

Referring to FIG. 8 in conjunction with FIG. 5, a left or right tilting adjustment operation of the mechanism is described below. Prior to adjustment, first unfasten the screws 331, 332, 341, and 342 with the half spherical ends of the adjustment screws 333 and 343 contacted the groove 21. There is a peripheral gap 334 either between a hole in the horizontal portion 301 and the screw 331 or between another hole in the horizontal portion 301 and the screw 332. Also, there is a peripheral gap 344 either between yet another hole in the horizontal portion 301 and the screw 341 or between a further hole in the horizontal portion 301 and the screw 342. Next, loosen the adjustment screw 333 by turning a first number of times and loosen the adjustment screw 343 by turning a second number of times different from the first number of times. As such, the horizontal portion 301 may tilt either to the left or to the right with respect to the carrier 20 because of the allowance provided by the gaps 334 and 344. As a result, the spindle unit 30 tilts at the same direction because the spindle unit 30 is fixedly connected to the horizontal portion 301.

Figure 9:
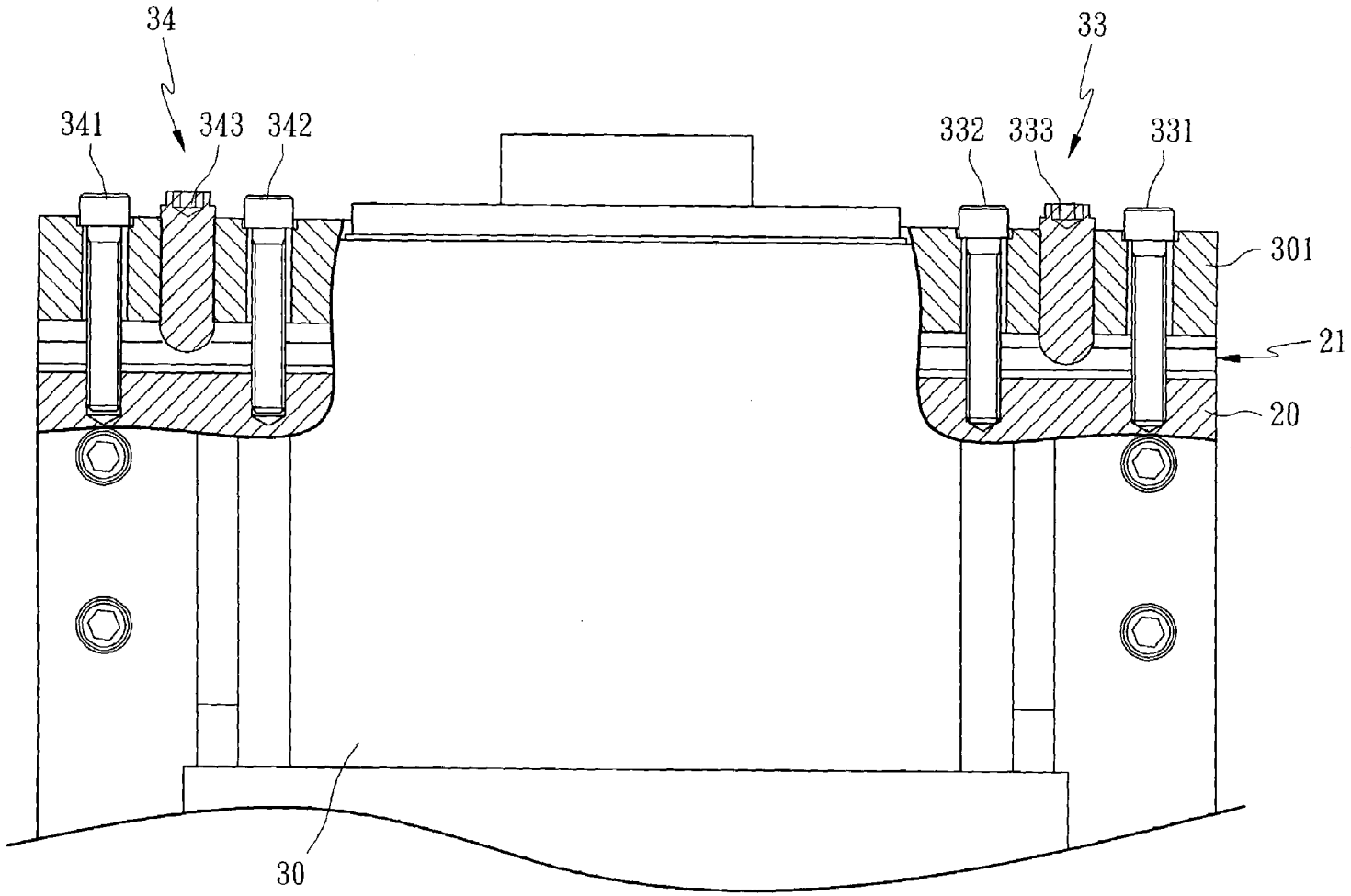
FIG. 9 is a view similar to FIG. 8 where the fine tilting adjustment mechanism has tilted to the left.

Preferably, the carrier 20 is tilted leftward with respect to an operator facing the carrier 20 for increasing efficiency. Thus, referring to FIG. 9 in conjunction with FIG. 5, an operator may turn the adjustment screw 333 more times than turn the adjustment screw 343. As such, the spindle unit 30 tilts leftward about the carrier 20. Next, operate an instrument (e.g., level) fixed to a lower surface of the spindle unit 30 to measure left, right, and central points of a chuck table. Finally, fasten the screws 331, 332, 341, and 342 again if the tilting readings of the left, right, and central points of the chuck table are correct. This completes the leftward tilting adjustment operation.

Figure 10:
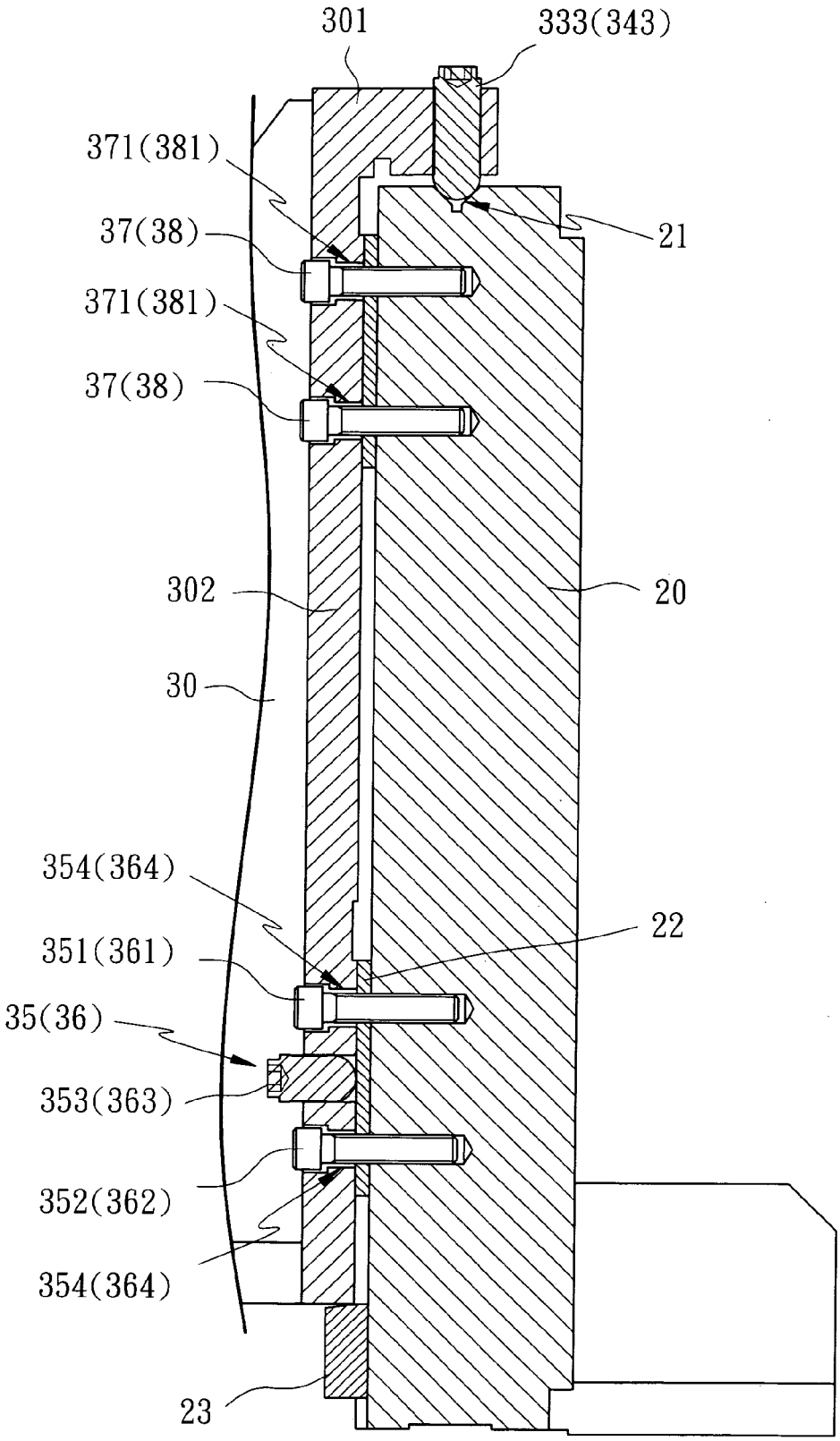
FIG. 10 is a sectional view of FIG. 7 for showing a forward or rearward tilting adjustment operation of the fine tilting adjustment mechanism.

Referring to FIG. 10 in conjunction with FIGS. 5 and 7, a forward or rearward tilting adjustment operation of the mechanism is described below. Prior to adjustment, first unfasten the screws 351, 352, 361, 362, 37, and 38 with the half spherical ends of the adjustment screws 353 and 363 contacted the pads 21. There is a peripheral gap 354 either between a hole in the vertical portion 302 and the screw 351 or between another hole in the vertical portion 302 and the screw 352. Also, there is a peripheral gap 364 either between yet another hole in the vertical portion 302 and the screw 361 or between a further hole in the vertical portion 302 and the screw 362. Next, loosen the adjustment screws 353 and 363 by turning the same number of times. As such, the vertical portion 302 may tilt either forward or rearward with respect to the adjustment screws 333 and 343 (i.e., pivot) because of the allowance provided by the gaps 354 and 364. As a result, the spindle unit 30 tilts at the same direction because the spindle unit 30 is fixedly connected to the vertical portion 302.

Figure 11:
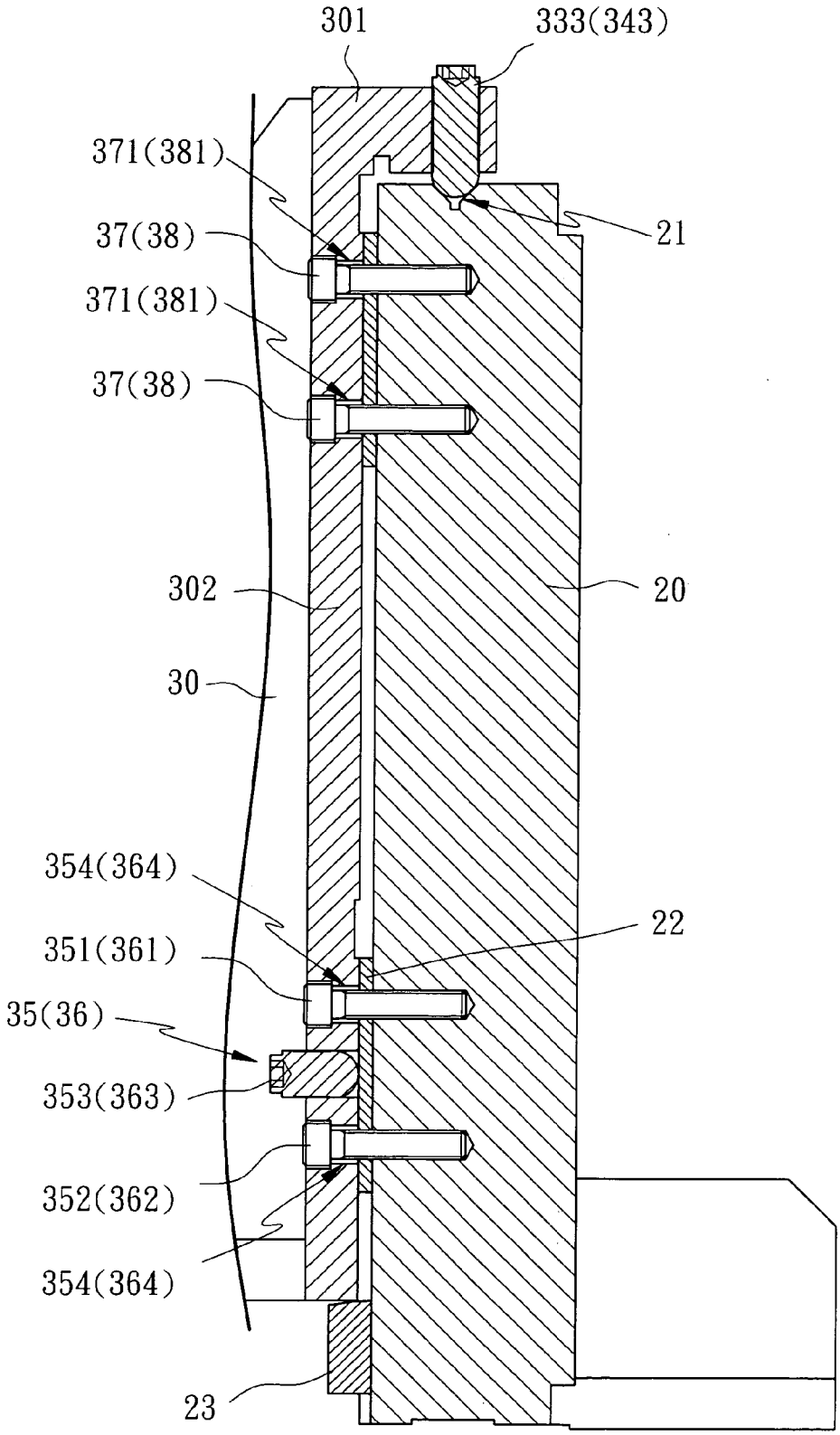
FIG. 11 is a view similar to FIG. 10 where the fine tilting adjustment mechanism has tilted to the front.

Preferably, the carrier 20 is tilted forward with respect to an operator facing the carrier 20 for meeting the requirements of semiconductor wafer grinding. Thus, referring to FIG. 11 in conjunction with FIGS. 5 and 7, an operator may loosen the adjustment screws 353 and 363 by turning the same number of times. As such, the spindle unit 30 tilts forward about the carrier 20. Next, operate the instrument (e.g., level) fixed to the lower surface of the spindle unit 30 to measure left, right, and central points of the chuck table. Finally, fasten the screws 351, 352, 361, 362, 37, and 38 again if the tilting readings of the left, right, and central points of the chuck table are correct. This completes the forward tilting adjustment operation.

Figure 12:
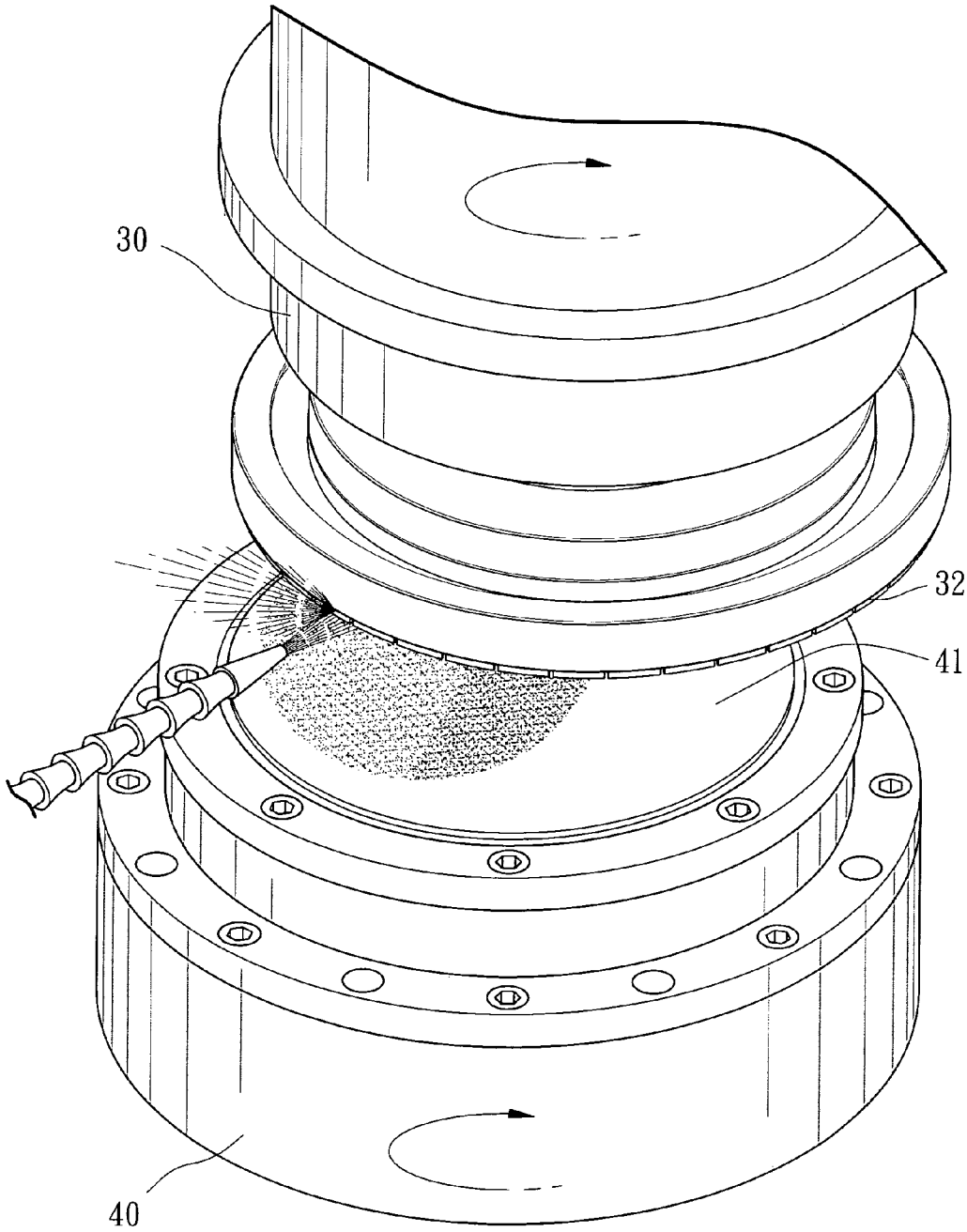
FIG. 12 is a perspective view of the rotating spindle unit tilted to both the left and front and the rotating chuck table in a semiconductor wafer grinding operation.

Referring to FIG. 12, in this perspective view the spindle unit 30 tilted to both the left and front is rotating to grind a semiconductor wafer 41 placed on a rotating chuck table 40 in which the segments of grindstone 32 on a bottom of the spindle unit 30 is operating to rub a left, front portion of the semiconductor wafer 41 for grinding evenly. The thickness of the semiconductor wafer 41 is measured by an appropriate instrument. Next, the thickness is compared with TTV. The grinding operation will be finished if the measured thickness of the semiconductor wafer 41 is less than TTV. Otherwise, adjust the tilting of the spindle unit 30 again by traversing the steps discussed above. In view of the above, the tilting adjustment is very easy, efficient, and effective through a simple mechanism.

While the invention herein disclosed has been described by means of specific embodiments, numerous modifications and variations could be made thereto by those skilled in the art without departing from the scope and spirit of the invention set forth in the claims.

What is claimed is:

1. In a grinding machine comprising an upright wall extended upwardly from a base, and an assembly provided at one side of the wall, the assembly including a hoisting member, a carrier engaged with the hoisting member, the carrier including a V-shaped groove across a top surface thereof and including a pad at outer sides of said carrier, and a spindle unit including an inverted L-shaped mounting plate having a horizontal portion and a vertical portion, a grinding wheel attached to a lower surface of said vertical portion, and segments of grindstone fixed to a lower surface of the grinding wheel, a fine tilting adjustment mechanism mountable on the grinding machine comprising:

first and second fastening units provided at both sides of the horizontal portion of the mounting plate respectively, each of the first and second fastening units including two first screws secured through the groove to secure the horizontal portion of the mounting plate to the carrier, each of said units including an intermediate adjustment screw adjustably driven through the horizontal portion of the mounting plate to contact the groove; and third and fourth fastening units provided at lower portions of both outer sides of the vertical portion of the mounting plate respectively, each of the third and fourth fastening units including two first screws secured through the pad to secure the vertical portion of the mounting plate to the carrier, each of said units including an intermediate adjustment screw adjustably driven through the vertical portion of the mounting plate to contact each pad, respectively.

2. The fine tilting adjustment mechanism of claim 1, wherein the V-shaped groove is subjected to surface hardening.

3. The fine tilting adjustment mechanism of claim 1, wherein the pads are subjected to surface hardening.

4. The fine tilting adjustment mechanism of claim 1, wherein the adjustment screw of each of the first and second fastening units has a half spherical end contacting the groove.

5. The fine tilting adjustment mechanism of claim 1, wherein the adjustment screw of each of the third and fourth fastening units has a half spherical end contacting each pad.

6. The fine tilting adjustment mechanism of claim 1, wherein the carrier further comprises a lower bracket urged against a bottom of the vertical portion of the mounting plate.

7. The fine tilting adjustment mechanism of claim 1, further comprising two pairs of second screws to secure upper portions of both outer sides of the vertical portion of the mounting plate to the carrier.

8. The fine tilting adjustment mechanism of claim 1, wherein the hoisting member is a rotary screw rod, the rotary screw rod adapted to rotate to drive up or down the carrier.

9. The fine tilting adjustment mechanism of claim 1, wherein either first screw of each of the first and second fastening units is spaced from the carrier by a peripheral gap having a depth about equal to a distance from the groove to a head of the first screw, the gaps adapted to allow the horizontal portion of the mounting plate and the spindle unit to tilt either to the left or to the right with respect to the carrier in response to unfastening the first screws of the first and second fastening units, loosening the adjustment screw of the first fastening unit by turning a first number of times, and loosening the adjustment screw of the second fastening unit by turning a second number of times different from the first number of times.

10. The fine tilting adjustment mechanism of claim 1, wherein either first screw of each of the third and fourth fastening units is spaced from the carrier by a peripheral gap having a depth about equal to a distance from either pad to a head of the first screw, the gaps adapted to allow the vertical portion of the mounting plate and the spindle unit to tilt either to the front or to the rear with respect to the adjustment screws of the first and second fastening units in response to unfastening the first screws of the third and fourth fastening units and loosening the adjustment screws of the third and fourth fastening units by turning the same number of times.

* * * * *